US009734770B2

(12) United States Patent
Gotoh et al.

(10) Patent No.: US 9,734,770 B2
(45) Date of Patent: Aug. 15, 2017

(54) DISPLAY DEVICE AND METHOD FOR DRIVING DISPLAY DEVICE

(71) Applicant: Japan Display Inc., Tokyo (JP)

(72) Inventors: Fumitaka Gotoh, Tokyo (JP); Tsutomu Harada, Tokyo (JP); Naoyuki Takasaki, Tokyo (JP)

(73) Assignee: Japan Display Inc., Tokyo (JP)

( * ) Notice: Subject to any disclaimer, the term of this patent is extended or adjusted under 35 U.S.C. 154(b) by 17 days.

(21) Appl. No.: 14/505,109

(22) Filed: Oct. 2, 2014

(65) Prior Publication Data

US 2015/0109349 A1 Apr. 23, 2015

(30) Foreign Application Priority Data

Oct. 22, 2013 (JP) ..... 2013-219690

(51) Int. Cl.
*G09G 3/36* (2006.01)

(52) U.S. Cl.
CPC ..... *G09G 3/36* (2013.01); *G09G 3/3607* (2013.01)

(58) Field of Classification Search
CPC ..... G09G 5/10; G09G 2320/0233; G09G 2320/062; G09G 3/3406; G02F 1/133603; G02F 1/133611
See application file for complete search history.

(56) References Cited

U.S. PATENT DOCUMENTS

2007/0115246 A1* 5/2007 Hayashi ..... G09G 3/342 345/102
2010/0194791 A1* 8/2010 Ogi et al. ..... 345/691
2010/0220048 A1* 9/2010 Yamamura et al. ..... 345/102
2012/0139885 A1* 6/2012 Iwasa ..... G09G 3/3426 345/207

FOREIGN PATENT DOCUMENTS

JP 2008-009415 A 1/2008
JP 2008-051905 3/2008
JP 2010-175913 8/2010

OTHER PUBLICATIONS

Japanese Office Action issued Feb. 23, 2016 for corresponding Japanese Application No. 2013-219690.

* cited by examiner

*Primary Examiner* — Michael Faragalla
*Assistant Examiner* — Chayce Bibbee
(74) *Attorney, Agent, or Firm* — Michael Best & Friedrich LLP

(57) ABSTRACT

A display device includes: an image display unit that includes an image display region; a plurality of light sources that are arranged corresponding to a plurality of partial regions included in the image display region and irradiate the partial regions with light; a light amount correction processing unit that detects that the partial regions are non-display regions in which no image is displayed, and corrects a light amount of the light sources based on a predetermined threshold when the partial regions adjacent to each other are continuous non-display regions; and a light source control unit that controls the light amount of the light sources.

6 Claims, 15 Drawing Sheets

DISPLAY DEVICE AND METHOD FOR DRIVING DISPLAY DEVICE

CROSS-REFERENCE TO RELATED APPLICATIONS

This application claims priority from Japanese Application No. 2013-219690, filed on Oct. 22, 2013, the contents of which are incorporated by reference herein in its entirety.

BACKGROUND

1. Technical Field

The present disclosure relates to a display device including an image display unit having an image display region, a method for driving the display device, and an electronic apparatus.

2. Description of the Related Art

In the related art, display devices have been developed that include a plurality of light-emitting diodes (LEDs) as a linear light source used as a backlight of a liquid crystal display panel (for example, refer to Japanese Patent Application Laid-open Publication No. 2010-175913 and Japanese Patent Application Laid-open Publication No. 2008-051905). In the display devices, a value (also called as luminance or brightness) distribution of image signals is calculated for each of a plurality of partial regions included in an image display region, and an amount of light of the backlight in each image display region is controlled. Due to this, a contrast ratio thereof is enhanced as compared with a non light-emitting display device in the related art.

In the display devices in the related art, when a background of the image display region is a black screen, a phenomenon called "black floating" may occur in some cases. The black floating is a phenomenon in which a luminance difference is caused based on a difference in luminous intensity of the backlight between a black screen in a specific partial region in which a high-saturation image (also called as a high-chroma image) is displayed in part of a partial region in the image display region and a black screen of a partial region in which no image is displayed that is adjacent to the specific partial region. The phenomenon of the black floating may be more remarkable in a red-green-blue-white (RGBW)-type image processing technique, which can display high-saturation images with lower power consumption by using a white (W) sub-pixel, than in a red-green-blue (RGB)-type image display technique using a main pixel including sub-pixels that are a red pixel (R), a green pixel (G), and a blue pixel (B) in the related art.

For the foregoing reasons, there is a need for a display device that can prevent the black floating from occurring even when the high-saturation image is displayed, the method for driving the display device, and the electronic apparatus.

SUMMARY

According to an aspect, a display device includes: an image display unit that includes an image display region;

a plurality of light sources that are arranged corresponding to a plurality of partial regions included in the image display region and irradiate the partial regions with light; a light amount correction processing unit that detects that the partial regions are non-display regions in which no image is displayed, and corrects an amount of light of the light sources based on a predetermined threshold when the partial regions adjacent to each other are continuous non-display regions; and a light source control unit that controls the amount of light of the light sources.

According to another aspect, a method for driving a display device, the method includes: detecting that a plurality of partial regions included in an image display region are non-display regions; and correcting an amount of light of light sources that are arranged corresponding to the non-display regions when the partial regions adjacent to each other are continuous non-display regions.

According to another aspect, an electronic apparatus includes: a display device including: an image display unit that includes an image display region; a plurality of light sources that are arranged corresponding to a plurality of partial regions included in the image display region and irradiate the partial regions with light; a light amount correction processing unit that detects that the partial regions are non-display regions in which no image is displayed, and corrects an amount of light of the light sources based on a predetermined threshold when the partial regions adjacent to each other are continuous non-display regions; and a light source control unit that controls the amount of light of the light sources; and a controller that controls the display device.

DETAILED DESCRIPTION

The following describes an embodiment of the present invention in detail with reference to the attached drawings. In the embodiment, a liquid crystal display device is exemplified as a display device. However, the present invention can be applied to various display devices, not limited to the liquid crystal display device.

Figure 1:
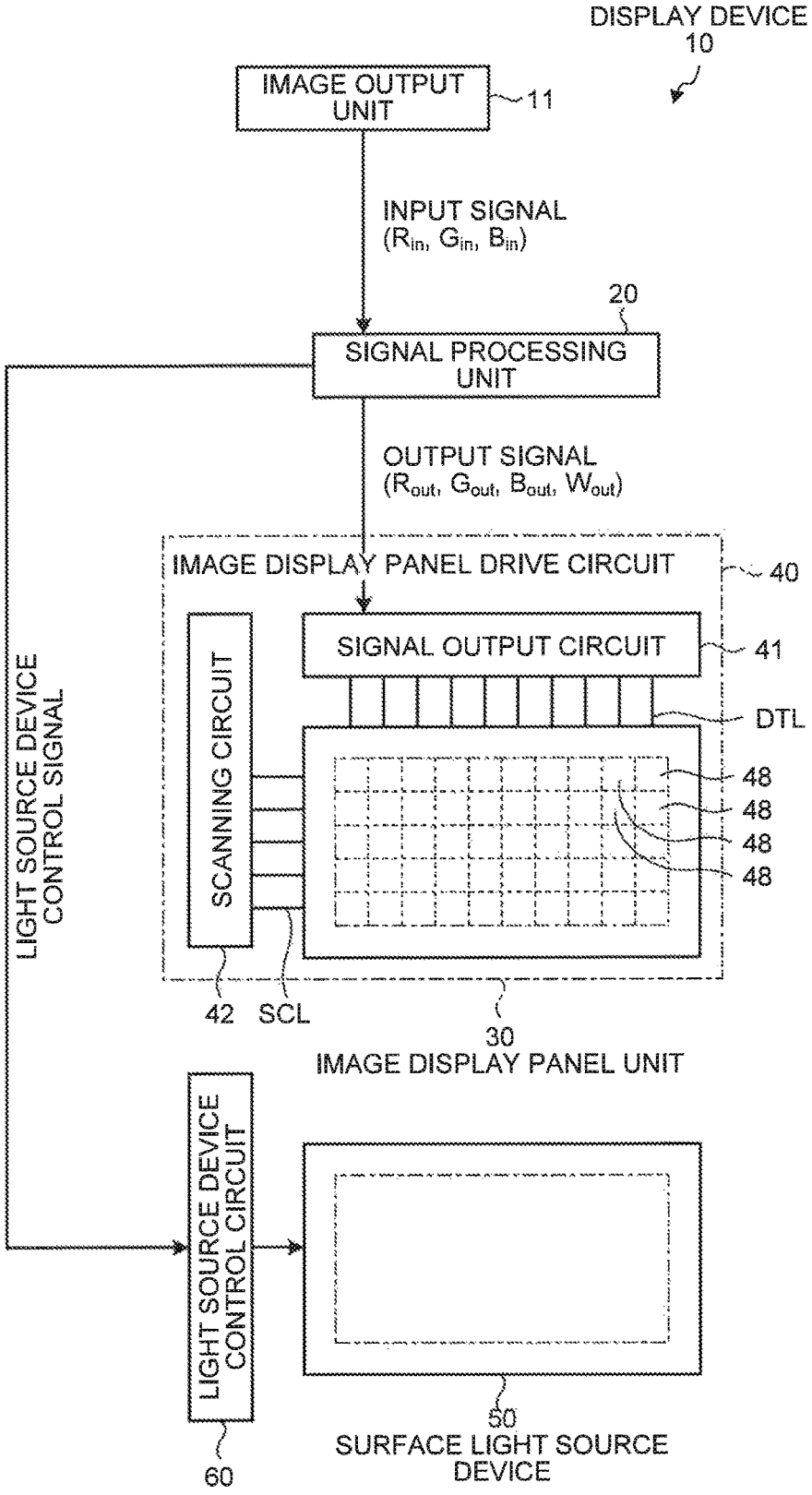
FIG. 1 is a functional block diagram illustrating a configuration example of a liquid crystal display device according to an embodiment of the present disclosure.
Figure 2:
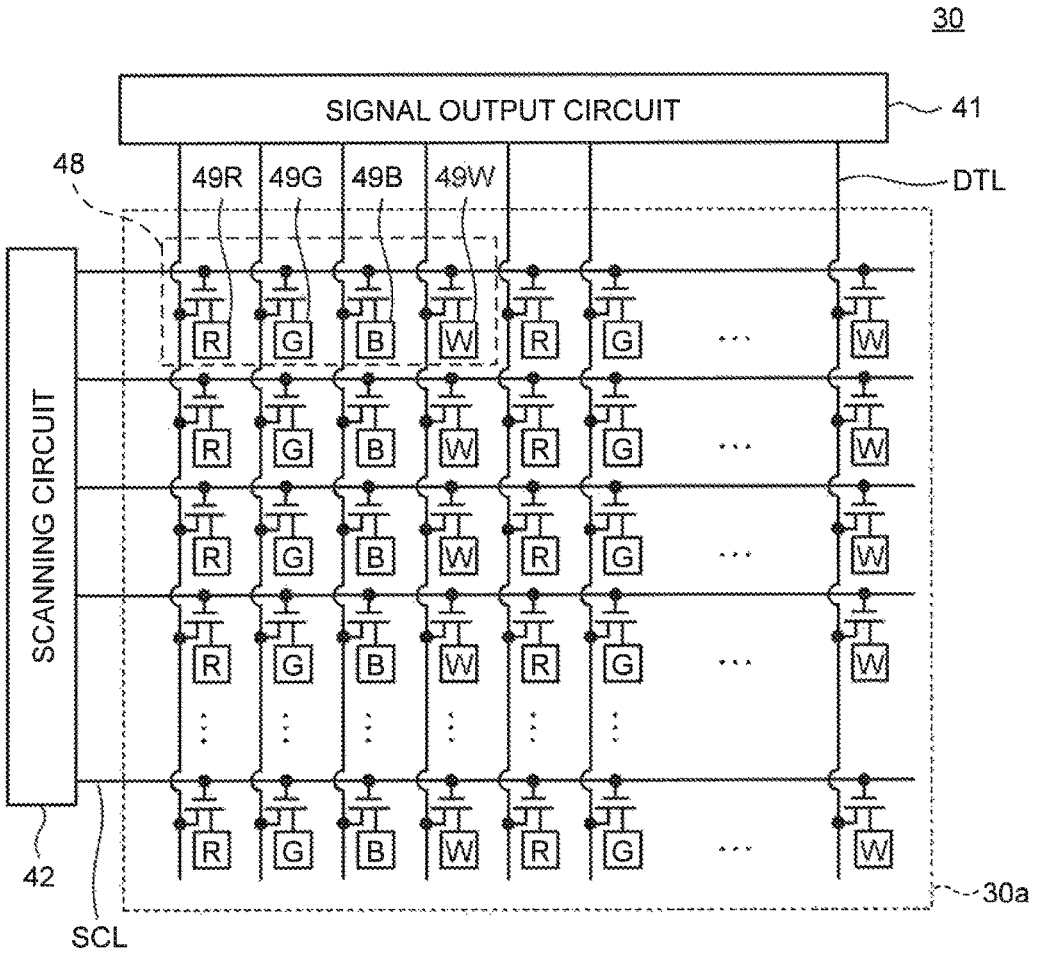
FIG. 2 is a wiring diagram of an image display panel unit in the liquid crystal display device illustrated in FIG. 1.

FIG. 1 is a functional block diagram illustrating a configuration example of the liquid crystal display device according to the embodiment. FIG. 2 is a wiring diagram of an image display panel unit in the liquid crystal display device illustrated in FIG. 1.

As illustrated in FIG. 1, a liquid crystal display device 10 (hereinafter, simply referred to as a "display device 10" in some cases) according to the embodiment includes: a signal processing unit 20 that receives an input signal (RGB data) from an image output unit 11 and executes predetermined data conversion processing to output the signal, an image display panel unit 30 that displays an image based on the output signal output from the signal processing unit 20, an image display panel drive circuit 40 that controls a display operation of the image display panel unit 30, a surface light source device 50 that irradiates an image display region 30*a* (not illustrated in FIG. 1, refer to FIG. 2) of the image display panel unit 30 with white light in a plane shape from the back surface of the image display panel unit 30, and a light source device control circuit (light source control unit) 60 that controls an operation of the surface light source device 50. The configuration of the display device 10 is similar to that of a display device assembly disclosed in Japanese Patent Application Laid-open Publication No. 2011-154323 (JP-A-2011-154323). Various modifications disclosed in JP-A-2011-154323 can be applied to the display device 10.

The signal processing unit 20 is an arithmetic processing unit that controls operations of the image display panel unit 30 and the surface light source device 50. The signal processing unit 20 is electrically coupled to the image display panel drive circuit 40 that drives the image display panel unit 30 and the light source device control circuit 60 that drives the surface light source device 50. The signal processing unit 20 executes data processing of the input signal (RGB data) that is received from the outside, outputs an output signal to the image display panel drive circuit 40, and generates and outputs a light source device control signal to the light source device control circuit 60.

The signal processing unit 20 performs predetermined color conversion processing on input signals (Rin, Gin, Bin) serving as RGB data represented by an energy ratio among R (red), G (green), and B (blue). The signal processing unit 20 then generates output signals (Rout, Gout, Bout, Wout) represented by an energy ratio among R (red), G (green), B (blue), and W (white), to which the fourth color W (white) is added. The signal processing unit 20 then outputs the generated output signals (Rout, Gout, Bout, Wout) to the image display panel drive circuit 40, and outputs the light source device control signal to the light source device control circuit 60. In the embodiment, an RGBW-type display device is described in which the signal processing unit 20 generates RGBW output signals. However, the present invention can also be applied to a display device in which the signal processing unit 20 generates RGB-type output signals.

Each of the input signals (Rin, Gin, Bin) is the RGB data indicating a specific color in the standard color gamut. Various standards applied to image display can be used as the standard color gamut. Examples thereof include, but are not limited to, the color gamut of the sRGB standard, the color gamut of the Adobe (registered trademark) RGB standard, and the color gamut of the NTSC standard. The sRGB standard is defined by the International Electrotechnical Commission (IEC). The Adobe (registered trademark) RGB standard is defined by Adobe Systems Incorporated. The NTSC standard is defined by the National Television System Committee.

As illustrated in FIG. 2, the image display panel unit 30 is a color liquid crystal display device including the image display region 30*a*. In the image display region 30*a*, a pixel 48 including a first sub-pixel 49R for displaying a first color (red), a second sub-pixel 49G for displaying a second color (green), a third sub-pixel 49B for displaying a third color (blue), and a fourth sub-pixel 49W for displaying a fourth color (white) is arranged in a two-dimensional matrix. A first color filter for transmitting light of the first color (red) is arranged between the first sub-pixel 49R and a display surface of the image display panel unit 30, a second color filter for transmitting light of the second color (green) is arranged between the second sub-pixel 49G and the display surface of the image display panel unit 30, and a third color filter for transmitting light of the third color (blue) is arranged between the third sub-pixel 49B and the display surface of the image display panel unit 30. A transparent resin layer for transmitting all colors is arranged between the fourth sub-pixel 49W and the display surface of the image display panel unit 30. There may be nothing between the fourth sub-pixel 49W and the display surface of the image display panel unit 30.

In the example illustrated in FIG. 2, the first sub-pixel 49R, the second sub-pixel 49G, the third sub-pixel 49B, and the fourth sub-pixel 49W are arranged similarly to a stripe array in the image display panel unit 30. The configuration and arrangement of sub-pixels included in one pixel are not specifically limited. For example, in the image display panel unit 30, the first sub-pixel 49R, the second sub-pixel 49G, the third sub-pixel 49B, and the fourth sub-pixel 49W may be arranged similarly to a diagonal array (mosaic array). Alternatively, for example, they may be arranged similarly to a delta array (triangle array), a rectangle array, or the like. Generally, the arrangement similar to a stripe array is suitable for displaying data and character strings in a personal computer and the like. In contrast, the arrangement similar to a mosaic array is suitable for displaying a natural image in a video camera recorder, a digital still camera, and the like.

The image display panel drive circuit 40 includes a signal output circuit 41 (signal output unit) and a scanning circuit 42. The signal output circuit 41 is electrically coupled to sub-pixels in pixels 48 of the image display panel unit 30 via wiring diode-transistor logic (DTL). The signal output circuit 41 outputs a driving voltage to be applied to a liquid crystal included in each sub-pixel based on the output signals (Rout, Gout, Bout, Wout) output from the signal processing unit 20, and controls transmittance of light emitted from the surface light source device 50 for each pixel. The scanning circuit 42 is electrically coupled, via wiring switch control logic (SCL), to a switching element for controlling an operation of each sub-pixel in each pixel 48 of the image display panel unit 30. The scanning circuit 42 sequentially outputs scanning signals to a plurality of pieces of wiring SCL, and applies each of the scanning signals to the switching element of the sub-pixel in each pixel 48 to turn ON the switching element. The signal output circuit 41 applies the driving voltage to the liquid crystal included in the sub-pixel to which the scanning signal from the scanning circuit 42 is applied. In this way, an image is displayed on the entire image display region 30*a* of the image display panel unit 30.

The surface light source device 50 is a backlight including various light sources and arranged on the back surface of the image display panel unit 30. The surface light source device 50 illuminates the image display panel unit 30 by emitting light from the light source to the image display panel unit 30.

The light source device control circuit 60 controls lighting quantity and/or a load of the light source in the surface light source device 50 based on the light source device control signal output from the signal processing unit 20, and adjusts an amount of light and intensity of light emitted from the surface light source device 50 to the image display panel unit 30. The light source device control circuit 60 can also control the light source and the intensity of light by controlling the lighting quantity and/or the load of part of the light sources.

Figure 3:
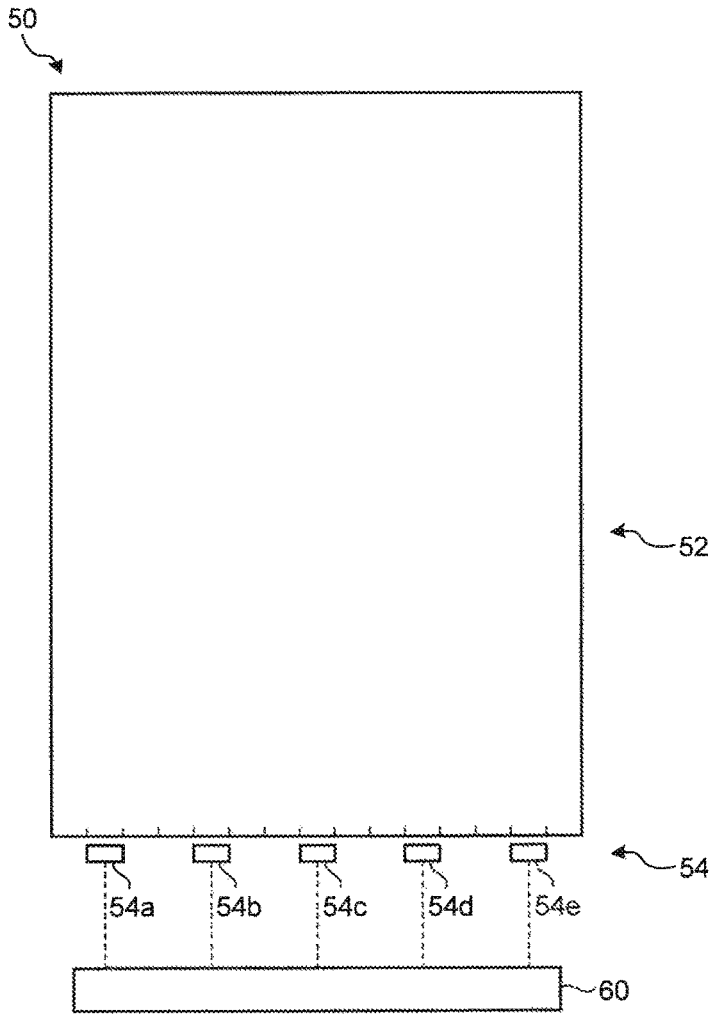
FIG. 3 is a schematic diagram of a surface light source device according to the embodiment of the present disclosure.

FIG. 3 is a schematic diagram of the surface light source device 50 according to the embodiment. As illustrated in FIG. 3, the surface light source device 50 includes a light guide plate 52 and a light source 54 arranged in the vicinity of an end face of the light guide plate 52. The light source 54 includes five light-emitting diodes (LEDs) 54*a* to 54*e* serving as point light sources arranged at a predetermined interval along one direction. An optical sheet and the like (not illustrated) are arranged on an emitting surface side of the light guide plate 52, a reflective sheet (not illustrated) is arranged on a surface opposed to the emitting surface of the light guide plate 52. The five LEDs 54*a* to 54*e* are electrically coupled to the light source device control circuit 60. The light guide plate 52 guides the light emitted from the five LEDs 54*a* to 54*e* to the inside via the end face, and emits the light guided to the inside toward the image display panel unit 30 from a principal plane. In the example of the embodiment, the light source 54 includes the five LEDs 54*a* to 54*e*. Alternatively, the number of LEDs included in the light source 54 may be appropriately modified. The light source 54 is not limited to the LEDs 54*a* to 54*e*, and may be configured using various point light sources and line light sources.

Figure 4:
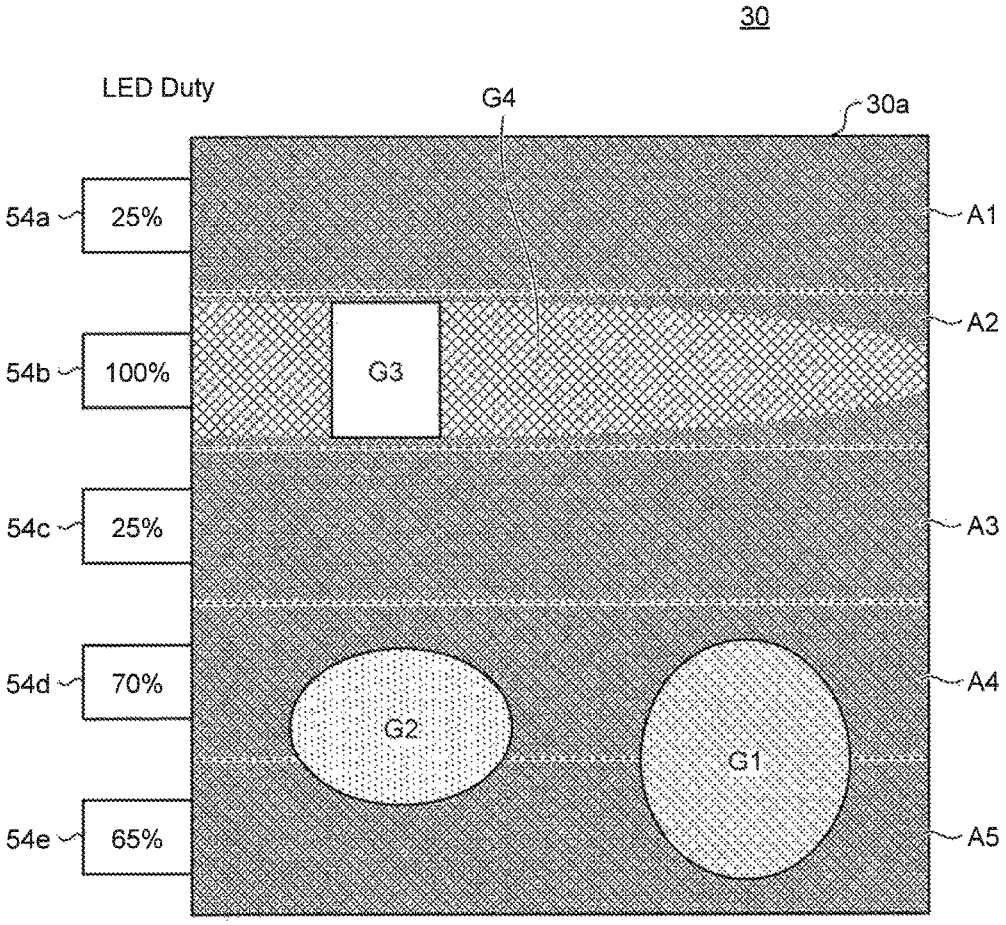
FIG. 4 is an explanatory diagram of an example of a luminance distribution in the image display panel unit according to the embodiment of the present disclosure.

Next, the following describes an example of a luminance distribution in the image display region 30*a* of the image display panel unit 30 with reference to FIG. 4. FIG. 4 is an explanatory diagram of an example of a luminance distribution in the image display panel unit 30. In the example illustrated in FIG. 4, the image display region 30*a* includes five partial regions A1 to A5. The LED 54*a* is arranged corresponding to the partial region A1. The LED 54*b* is arranged corresponding to the partial region A2. The LED 54*c* is arranged corresponding to the partial region A3. The LED 54*d* is arranged corresponding to the partial region A4. The LED 54*e* is arranged corresponding to the partial region A5.

The partial regions A1 and A3 in the image display region 30*a* are non-display regions in which no image is displayed (hereinafter, also referred to as a "black screen"). A low-saturation image G1 and an intermediate-saturation image G2 are displayed in the partial regions A4 and A5. A high-saturation image G3 is displayed in the partial region A2. In this case, lighting quantity (load) of the LEDs 54*a* and 54*c* that are arranged corresponding to the partial regions A1 and A3 is controlled, for example, to be 25%. The lighting quantity (load) of the LED 54*b* that is arranged corresponding to the partial region A2 is controlled, for example, to be 100%. The lighting quantity (load) of the LED 54*d* that is arranged corresponding to the partial region A4 is controlled, for example, to be 70%. The lighting quantity (load) of the LED 54*e* that is arranged corresponding to the partial region A5 is controlled, for example, to be 65%. As described above, in the example illustrated in FIG. 4, a difference in lighting quantity of the LEDs 54*a* and 54*c* and the LED 54*b* is 75% between the partial regions A1 and A3 and the partial region A2 that are adjacent to each other. Accordingly, black floating G4 occurs in a region in which the high-saturation image G3 is not displayed in the partial region A2 to which light of the LED 54*b* the lighting quantity of which is large is emitted.

Figure 5:
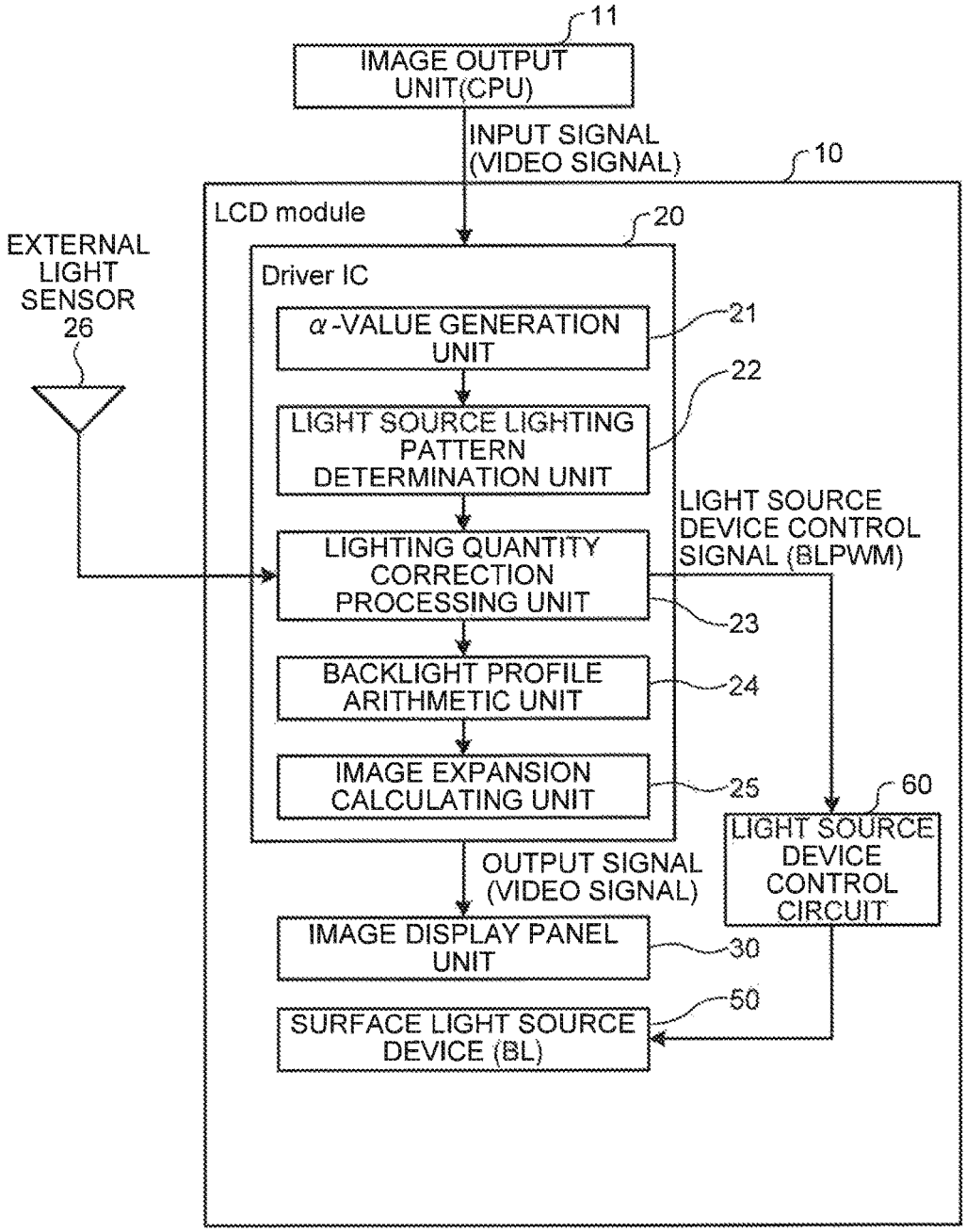
FIG. 5 is a functional block diagram of surroundings of a signal processing unit in the liquid crystal display device according to the embodiment of the present disclosure.

Next, the following describes signal processing in the display device 10 according to the embodiment in detail with reference to FIG. 5. FIG. 5 is a functional block diagram of surroundings of the signal processing unit 20 in the display device 10 according to the embodiment. As illustrated in FIG. 5, the signal processing unit 20 of the liquid crystal display device 10 according to the embodiment includes an α-value generation unit 21, a light source lighting pattern determination unit 22, a lighting quantity correction processing unit 23, a backlight profile arithmetic unit 24, and an image expansion calculating unit 25.

To the α-value generation unit 21, input signals (Rin, Gin, Bin) are input as video signals (RGB data) from the outside. The α-value generation unit 21 calculates an expansion coefficient α from the input signals (Rin, Gin, Bin). The α-value generation unit 21 performs linear conversion as reverse γ correction on the input signals (Rin, Gin, Bin) input from the outside. When the input signals (Rin, Gin, Bin) are the RGB data represented by 8 bits (0 to 255), for example, the α-value generation unit 21 normalizes each value of an R component, a G component, and a B component of the RGB data to be a value of 0 to 1.

The light source lighting pattern determination unit 22 determines lighting patterns of the LEDs 54*a* to 54*e* of the light source 54 based on an α-value generated by the α-value generation unit 21.

The lighting quantity correction processing unit 23 determines whether there are continuous black screens in the partial regions A1 to A5 of the image display region 30*a*. If there are continuous black screens, a black screen continuous flag is set to the LEDs 54*a* to 54*e* that are arranged corresponding to the partial regions. The lighting quantity correction processing unit 23 also detects the lighting quantity of the LEDs 54*a* to 54*e* to which the black screen continuous flag is set, and corrects the lighting quantity of the LEDs 54*a* to 54*e* of a light source control signal based on a difference value of the detected lighting quantity and a threshold set in advance. Due to the correction of the lighting quantity of the LEDs 54*a* to 54*e* of the light source control signal, it is possible to prevent the black floating in the image display panel unit 30 based on the luminance difference caused by the difference in the lighting quantity of the LEDs 54*a* to 54*e*. The lighting quantity correction processing unit 23 outputs the corrected light source control signal together with the RGBW data to the backlight profile arithmetic unit 24, and also to the light source device control circuit 60.

In the embodiment, the lighting quantity correction processing unit 23 preferably corrects the lighting quantity by scanning the LEDs 54*a* to 54*e* arranged in parallel along a certain direction to which the black screen continuous flag is set along a certain direction, and then corrects the lighting quantity by scanning again the LEDs 54*a* to 54*e* to which the black screen continuous flag is set along the reverse direction of the certain direction. The lighting quantity correction processing unit 23 compares the difference value of the lighting quantity of the LEDs 54*a* to 54*e* to which the black screen continuous flag is set with the threshold set in advance. If the difference value is equal to or smaller than the threshold, the lighting quantity correction processing unit 23 may increase the lighting quantity of the LEDs 54*a* to 54*e* the lighting quantity of which is low to be approximated to the lighting quantity of the LEDs 54*a* to 54*e* the lighting quantity of which is high. In this way, because the lighting quantity of the LEDs 54*a* to 54*e* can be corrected through one reciprocating scanning, an algorithm can be simplified.

The threshold used for correcting the lighting quantity of the LEDs 54*a* to 54*e* by the lighting quantity correction processing unit 23 can be set in an arbitrary range from 0% to 100% as a ratio between the luminance and a contrast (luminance/contrast). In this case, when the threshold of luminance/contrast is 0%, the lighting quantity correction processing unit 23 corrects the lighting quantity to be the same among the LEDs 54*a* to 54*e* to which the black screen continuous flag is set. When the threshold of luminance/contrast is 100%, the lighting quantity correction processing unit 23 does not correct the lighting quantity of the LEDs 54*a* to 54*e* to which black screen continuous flag is set. The black floating tends to be more inconspicuous in a dark environment than that in a bright environment, so that the threshold used for correcting the lighting quantity can be appropriately changed corresponding to a use condition and the like of the display device 10. The following represents examples of the threshold used for correcting the lighting quantity.

threshold 10%=luminance(500 cd/m$^2$)/contrast(1000)

threshold 15%=luminance(500 cd/m$^2$)/contrast(1500)

threshold 20%=luminance(500 cd/m$^2$)/contrast(2000)

threshold 22%=luminance(450 cd/m$^2$)/contrast(2000)

The backlight profile arithmetic unit 24 creates a backlight profile through an arithmetic operation based on the RGB data input from the lighting quantity correction processing unit 23 and the corrected light source device control signal. The backlight profile arithmetic unit 24 outputs the RGB data together with the created backlight profile to the image expansion calculating unit 25.

The image expansion calculating unit 25 generates and expands the RGBW data based on the expansion coefficient $\alpha$ from the backlight profile arithmetic unit 24. The image expansion calculating unit 25 calculates the output signal of the first sub-pixel based on the input signal of the first sub-pixel, the expansion coefficient $\alpha$, and the output signal of the fourth sub-pixel, calculates the output signal of the second sub-pixel based on the input signal of the second sub-pixel, the expansion coefficient $\alpha$, and the output signal of the fourth sub-pixel, and calculates the output signal of the third sub-pixel based on the input signal of the third sub-pixel, the expansion coefficient $\alpha$, and the output signal of the fourth sub-pixel. The image expansion calculating unit 25 outputs the calculated output signals of the first sub-pixel, the second sub-pixel, the third sub-pixel, and the fourth sub-pixel to the image display panel unit 30.

According to the embodiment, the signal processing unit 20 converts the input signals (Rin, Gin, Bin) into the output signals (Rout, Gout, Bout, Wout) to distribute quantity of transmitted light of the surface light source device 50 to the fourth sub-pixel 49W of the pixel 48 based on the W (white) component, so that the light can be transmitted from the fourth sub-pixel 49W the light transmittance of which is the highest. Due to this, transmittance of the entire color filter can be improved, so that quantity of light passing through the color filter can be maintained even when the light output from the surface light source device 50 is reduced, and power consumption of the surface light source device 50 can be reduced while maintaining the luminance of the image.

An external light sensor 26 detects the luminance in the image display region 30*a* of the image display panel unit 20. Corresponding to the luminance detected by the external light sensor 26, the lighting quantity correction processing unit 23 detects whether there is a non-display region (black screen) in the image display region 30*a*. The external light sensor 26 may determine the non-display region by comparing the detected luminance with a luminance value that is arbitrarily set by a user. In this case, for example, the non-display region is hardly determined when the user sets a high luminance value, so that the power consumption of the display device 10 can be reduced. The non-display region can be easily determined when the user sets a low luminance value, so that the display quality can be improved.

The functions of the $\alpha$-value generation unit 21, the light source lighting pattern determination unit 22, the lighting quantity correction processing unit 23, the backlight profile arithmetic unit 24, and the image expansion calculating unit 25 may be implemented by hardware or software, and are not specifically limited. Even if each component of the signal processing unit 20 is configured by hardware, circuits do not need to be physically and independently distinguished from each other, and a plurality of functions may be implemented by a physically single circuit.

Next, the following describes the method for driving the display device according to the embodiment. The method for driving the display device according to the embodiment includes a first step for detecting that the partial regions A1 to A5 included in the image display region 30*a* of the image display panel unit 30 are non-display regions, and a second step for controlling an amount of light of the light source 54 that is arranged corresponding to the non-display regions when the partial regions A1 to A5 adjacent to each other are continuous non-display regions.

Figure 6:
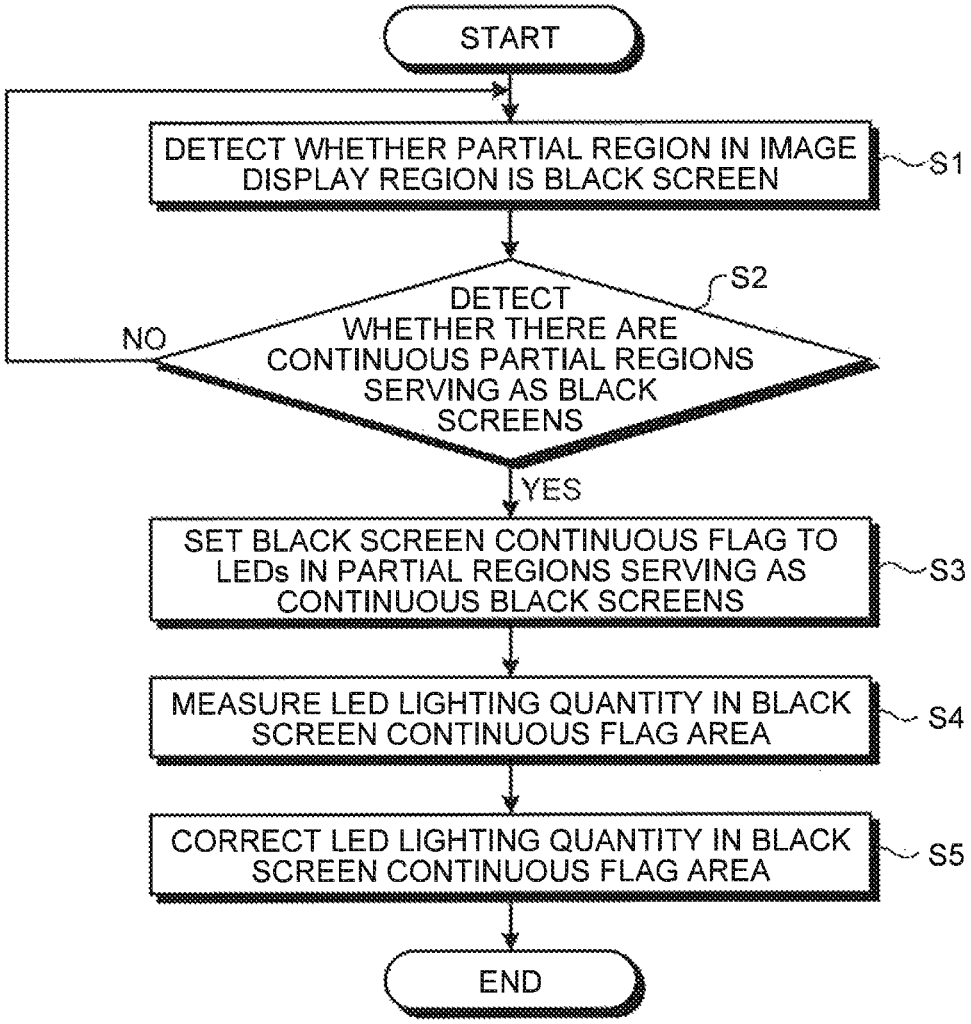
FIG. 6 is a flowchart schematically illustrating a method for driving the display device according to the embodiment of the present disclosure.
Figure 7:
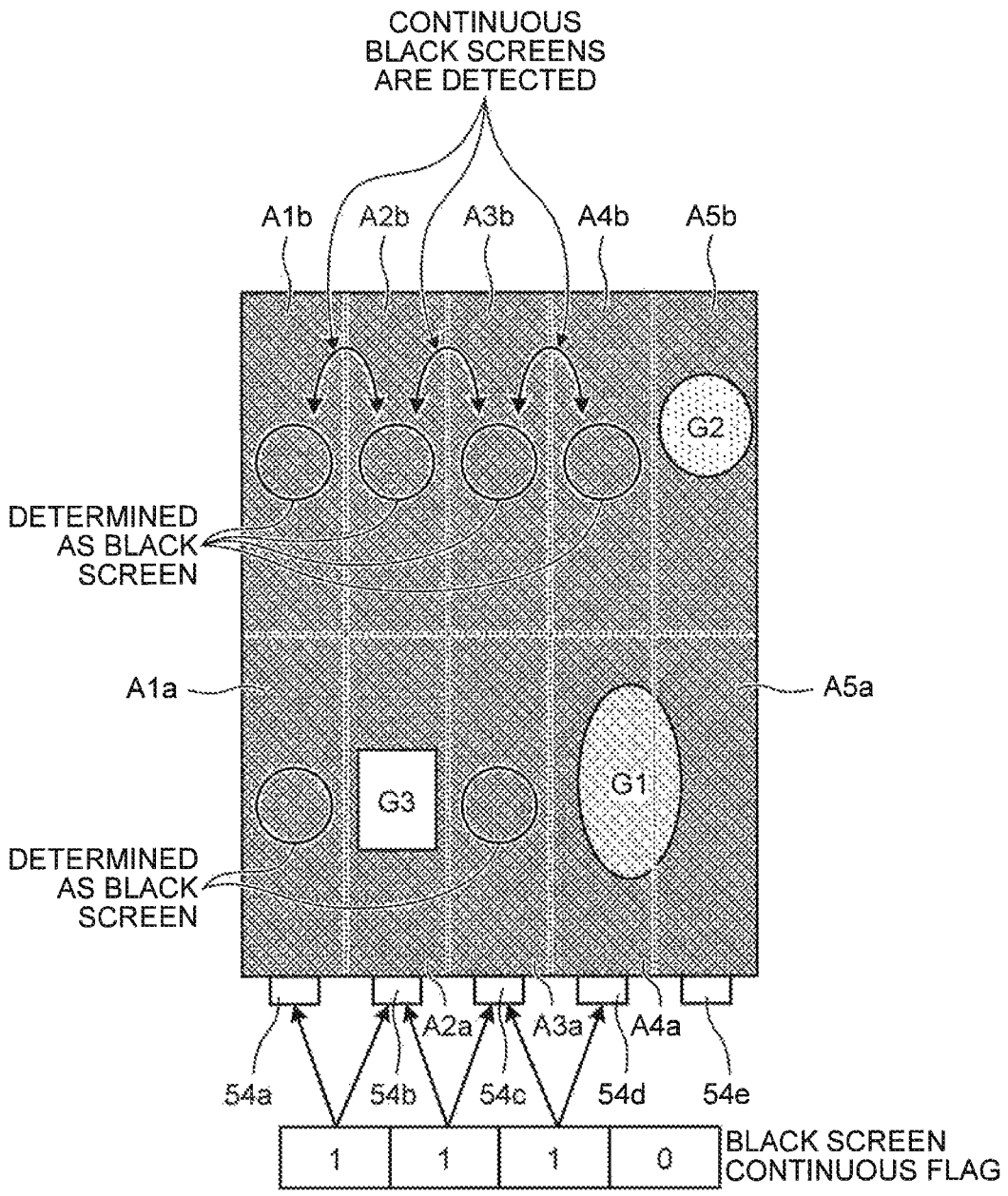
FIG. 7 is an explanatory diagram of the method for driving the display device according to the embodiment of the present disclosure.
Figure 8A:
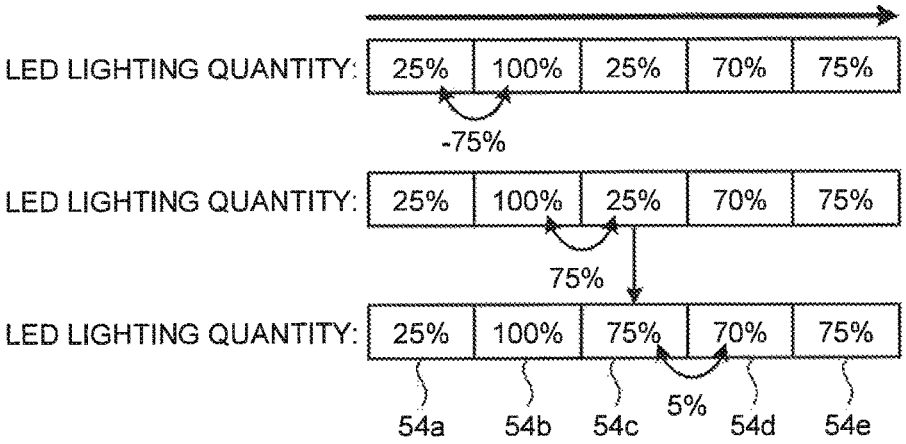
FIG. 8A is an explanatory diagram of the method for driving the display device according to the embodiment of the present disclosure.
Figure 8B:
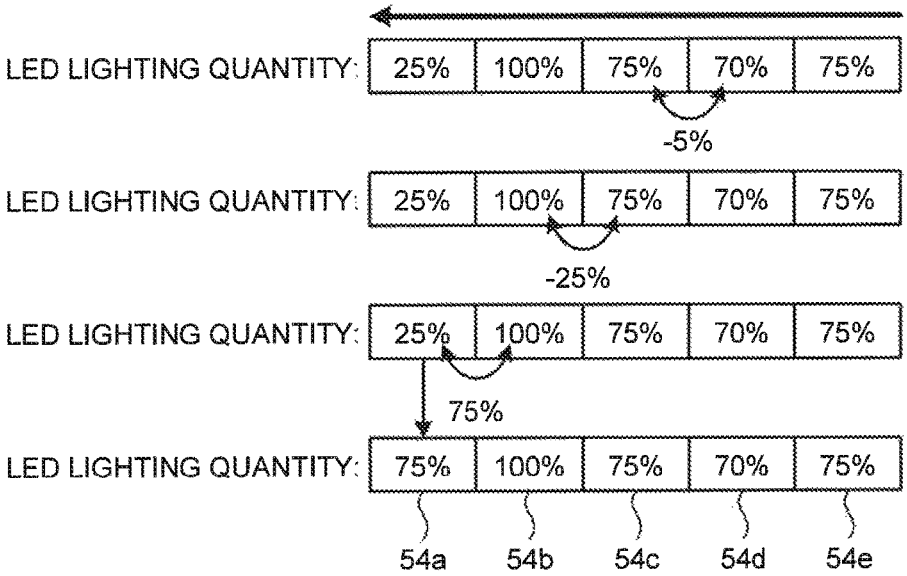
FIG. 8B is an explanatory diagram of the method for driving the display device according to the embodiment of the present disclosure.

FIG. 6 is a flowchart schematically illustrating the method for driving the display device according to the embodiment, and FIG. 7 to FIG. 8B are explanatory diagrams of the method for driving the display device according to the embodiment. In the example illustrated in FIG. 7, the lighting quantity correction processing unit 23 partitions the image display region 30*a* into ten partial regions A1a to A5b.

At the first step, the lighting quantity correction processing unit 23 determines whether each of the ten partial regions A1a to A5b in the image display region 30*a* of the image display panel unit 30 is the black screen, that is, the non-display region (FIG. 6: Step S1). Herein, as illustrated in FIG. 7, the lighting quantity correction processing unit 23 compares a predetermined threshold with the luminance of each of the partial regions A1a to A5b detected by the external light sensor 26, and determines whether each of the partial regions A1a to A5b is the black screen, that is, the non-display region. In the example illustrated in FIG. 7, the partial regions A1a, A3a, A1b, A2b, A3b, and A4b are determined as the non-display regions in which any of the low-saturation image G1, the intermediate-saturation image G2, and the high-saturation image G3 is not displayed.

Subsequently, the lighting quantity correction processing unit 23 detects whether there are two or more continuous partial regions as the black screens, that is, the non-display regions (FIG. 6: Step S2). If there are no continuous black screens (FIG. 6: No at Step S2), the lighting quantity correction processing unit 23 detects whether the partial region in the image display region is the non-display region. If there are continuous partial regions serving as the black screens (FIG. 6: Yes at Step S2), the lighting quantity correction processing unit 23 sets the black screen continuous flag to the LEDs 54*a* to 54*d* corresponding to the continuous black screens (FIG. 6: Step S3). In the example of FIG. 7, because there are continuous partial regions A1b to A4b as the black screens, that is, the non-display regions, the lighting quantity correction processing unit 23 sets the black screen continuous flag "1" to the four LEDs 54*a* to 54*d* that are arranged corresponding to the partial regions A1b to A4b.

Next, the lighting quantity correction processing unit 23 measures the lighting quantity of the LEDs 54*a* to 54*d* in a black screen continuous flag area (Step S4), and corrects the lighting quantity of the LEDs 54*a* to 54*d* in the black screen continuous flag area of the light source device control signal (Step S5). In the example illustrated in FIG. 8A and FIG. 8B, the lighting quantity correction processing unit 23 detects the lighting quantity of the LEDs 54*a*, 54*b*, 54*c*, and 54*d* to which the black screen continuous flag is set in this order along one direction (refer to the arrow in FIG. 8A) in the image display region 30*a*. The lighting quantity correction processing unit 23 then detects the lighting quantity of the LEDs 54*d*, 54*c*, 54*b*, and 54*a* to which the black screen continuous flag is set in this order along the reverse direction of the one direction in the image display region 30*a* (refer to the arrow in FIG. 8B).

First, the lighting quantity correction processing unit 23 compares the lighting quantity "25%" of the LED 54*a* with the lighting quantity "100%" of the LED 54*b* to both of which the black screen continuous flag is set, and detects that the difference value of the lighting quantity of the LED 54*a* with respect to that of the LED 54*b* is "−75%". The lighting quantity correction processing unit 23 then compares the detected difference value "−75%" with the threshold "25%" set in advance, and determines that the detected difference value is equal to or smaller than the threshold. In this case, the lighting quantity correction processing unit 23 does not correct the lighting quantity of the LED 54*a* and the LED 54*b*.

Next, the lighting quantity correction processing unit 23 compares the lighting quantity "100%" of the LED 54*b* with the lighting quantity "25%" of the LED 54*c* to both of which the black screen continuous flag is set, and detects that the difference value of the lighting quantity of the LED 54*b* with respect to that of the LED 54*c* is "75%". The lighting quantity correction processing unit 23 then compares the detected difference value "75%" with the threshold "25%" set in advance, determines that the detected difference value is equal to or larger than the threshold, and corrects the lighting quantity of the LED 54*c* to be increased to "75%" so that the difference value becomes equal to or smaller than the threshold "25%". Accordingly, in the liquid crystal display device 10, the difference between the lighting quantity of the LED 54*b* of the partial region A2 including a high-saturation display region and the lighting quantity of the LED 54*c* of the partial region A3 with no display region is decreased to be equal to or smaller than the threshold "25%". Due to this, it is possible to reduce a gradation difference between the black screen in the partial region A2 and the black screen in the partial region A3, and prevent the black floating from occurring in the partial region A2.

Next, the lighting quantity correction processing unit 23 compares the corrected lighting quantity "75%" of the LED 54*c* and the lighting quantity "70%" of the LED 54*d* to both of which the black screen continuous flag is set, and detects that the difference value of the lighting quantity of the LED 54*c* with respect to that of the LED 54*d* is "5%". The lighting quantity correction processing unit 23 then compares the detected difference value "5%" with the threshold "25%" set in advance, and determines that the detected difference value is equal to or smaller than the threshold. In this case, the lighting quantity correction processing unit 23 does not correct the lighting quantity of the LED 54*c* and the LED 54*d*.

Subsequently, the lighting quantity correction processing unit 23 compares the lighting quantity "70%" of the LED 54*d* with the corrected lighting quantity "75%" of the LED 54*c* to both of which the black screen continuous flag is set, and detects that the difference value of the lighting quantity of the LED 54*d* with respect to that of the LED 54*c* is "−5%". The lighting quantity correction processing unit 23 then compares the detected difference value "−5%" with the threshold "25%" set in advance, and determines that the detected difference value is equal to or smaller than the threshold. In this case, the lighting quantity correction processing unit 23 does not correct the lighting quantity of the LED 54*d* and the LED 54*c*.

Next, the lighting quantity correction processing unit 23 compares the corrected lighting quantity "75%" of the LED 54*c* with the lighting quantity "100%" of the LED 54*b* to both of which the black screen continuous flag is set, and detects that the difference value of the lighting quantity of the LED 54*c* with respect to that of the LED 54*b* is "−25%". The lighting quantity correction processing unit 23 then compares the detected difference value "−25%" with the threshold "25%" set in advance, and determines that the detected difference value is equal to or smaller than the threshold. In this case, the lighting quantity correction processing unit 23 does not correct the lighting quantity of the LED 54*c* and the LED 54*b*.

Next, the lighting quantity correction processing unit 23 compares the lighting quantity "100%" of the LED 54*b* with the lighting quantity "25%" of the LED 54*a* to both of which the black screen continuous flag is set, and detects that the difference value of the lighting quantity of the LED 54*a* with respect to the LED 54*b* is "75%". The lighting quantity correction processing unit 23 then compares the detected difference value "75%" with the threshold "25%" set in advance, determines that the detected difference value is equal to or larger than the threshold, and corrects the lighting quantity of the LED 54*a* to be increased to "75%" so that the difference value becomes equal to or smaller than the threshold "25%". Accordingly, in the liquid crystal display device 10, the difference between the lighting quantity of the LED 54*b* of the partial region A2 including the high-saturation display region and the lighting quantity of the LED 54*a* of the partial region A1 with no display region is decreased to be equal to or smaller than the threshold "25%". Due to this, it is possible to reduce the gradation difference between the black screen in the partial region A2 and the black screen in the partial region A1, and prevent the black floating from occurring in the partial region A2.

As described above, the lighting quantity correction processing unit 23 completes the correction of the lighting quantity of the LEDs 54*a* to 54*d* of the light source device control signal. Subsequently, the lighting quantity correction processing unit 23 outputs the light source device control signal in which the LEDs 54*a* to 54*d* are corrected to the light source device control circuit 60. The light source device control circuit 60 controls actual lighting quantity of the LEDs 54*a* to 54*e* based on the corrected light source device control signal input from the lighting quantity correction processing unit 23. The values of the lighting quantity and the threshold described above are exemplary only, and not limited thereto.

In the example of the embodiment described above, the lighting quantity correction processing unit 23 controls the lighting quantity of the LEDs 54*a* to 54*d* one by one. Alternatively, the lighting quantity correction processing unit 23 may collectively control the lighting quantity of a plurality of light sources using an average value of the lighting quantity of the light sources. In a case in which the light source device control circuit 60 dividedly drives the LEDs 54*a* to 54*e*, the power consumption can be further reduced by correcting the light source device control signal in the LEDs 54*a* to 54*e* to be dividedly driven.

As described above, in the display device according to the embodiment, the lighting quantity correction processing unit 23 corrects the lighting quantity of each of the LEDs 54*a* to 54*e* when the partial regions A1 to A5 adjacent to each other are continuous non-display regions. Accordingly, the black floating G4 can be prevented from occurring in the image display region 30*a* even when the high-saturation image G3 is displayed in the image display region 30*a*.

Preferably, the signal processing unit 20 calculates an amount of light at each position based on the lighting quantity of each of the LEDs 54*a* to 54*e* corrected by the lighting quantity correction processing unit 23, and corrects an image signal based on a result thereof. Due to this, an image to be displayed is caused to have high reproducibility.

Next, the following describes an electronic apparatus including the display device 10 according to the embodiment with reference to FIG. 9 to FIG. 22. FIG. 9 to FIG. 22 are diagrams illustrating an example of the electronic apparatus including the display device 10 according to the embodiment. The display device 10 can be applied to electronic apparatuses in various fields such as a television apparatus, a digital camera, a notebook-type personal computer, portable electronic apparatuses including a mobile phone, or a video camera. In other words, the display device 10 can be applied to electronic apparatuses in various fields that display a video signal input from the outside or a video signal generated inside as an image or video.

Application Example 1

Figure 9:
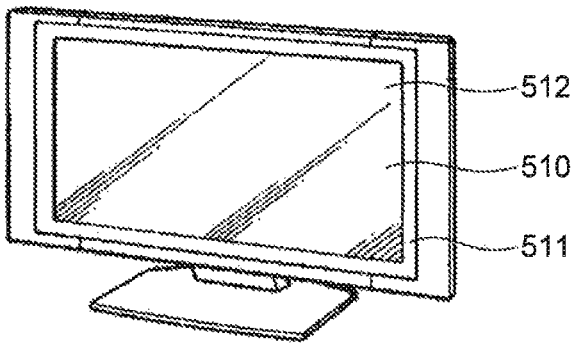
FIG. 9 is a diagram illustrating an example of an electronic apparatus including the display device according to the embodiment of the present disclosure.

The electronic apparatus illustrated in FIG. 9 is a television apparatus to which the display device 10 is applied. The television apparatus includes, for example, a video display screen unit 510 including a front panel 511 and a filter glass 512. The display device 10 is applied to the video display screen unit 510. A screen of the television apparatus has a function of detecting a touch operation, in addition to a function of displaying an image.

Application Example 2

Figure 10:
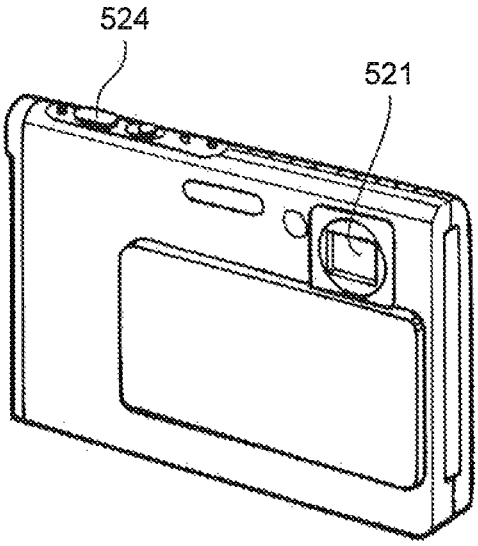
FIG. 10 is a diagram illustrating an example of the electronic apparatus including the display device according to the embodiment of the present disclosure.
Figure 11:
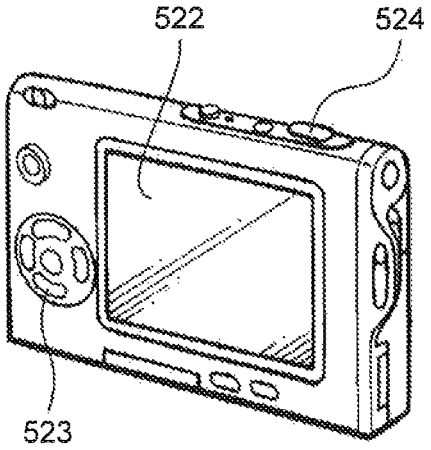
FIG. 11 is a diagram illustrating an example of the electronic apparatus including the display device according to the embodiment of the present disclosure.

The electronic apparatus illustrated in FIG. 10 and FIG. 11 is a digital camera to which the display device 10 is applied. The digital camera includes, for example, a flash light-emitting unit 521, a display unit 522, a menu switch 523, and a shutter button 524. The display device 10 is applied to the display unit 522. Accordingly, the display unit 522 of the digital camera has a function of detecting a touch operation, in addition to a function of displaying an image.

Application Example 3

Figure 12:
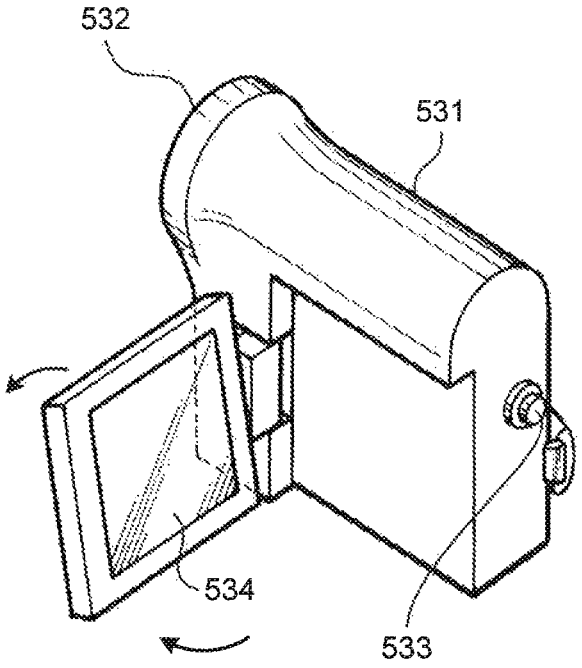
FIG. 12 is a diagram illustrating an example of the electronic apparatus including the display device according to the embodiment of the present disclosure.

The electronic apparatus illustrated in FIG. 12 represents an external appearance of a video camera to which the display device 10 is applied. The video camera includes, for example, a main body 531, a lens 532 for photographing a subject arranged on a front side of the main body 531, a start/stop switch 533 in photographing, and a display unit 534. The display device 10 is applied to the display unit 534. Accordingly, the display unit 534 of the video camera has a function of detecting a touch operation, in addition to a function of displaying an image.

Application Example 4

Figure 13:
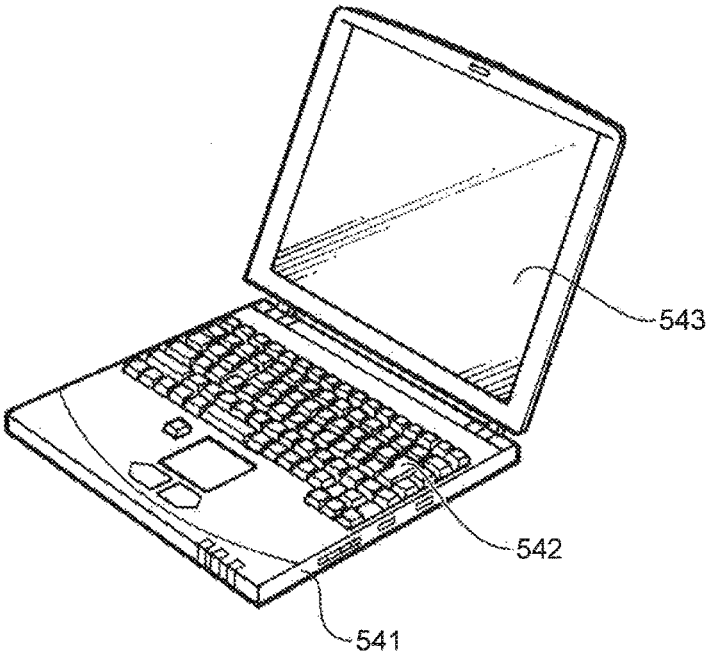
FIG. 13 is a diagram illustrating an example of the electronic apparatus including the display device according to the embodiment of the present disclosure.
Figure 14:
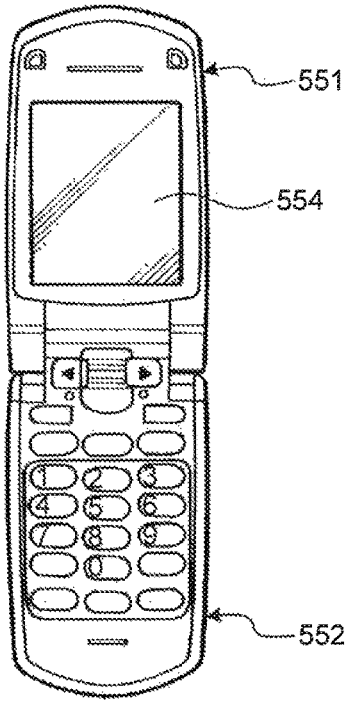
FIG. 14 is a diagram illustrating an example of the electronic apparatus including the display device according to the embodiment of the present disclosure.
Figure 15:
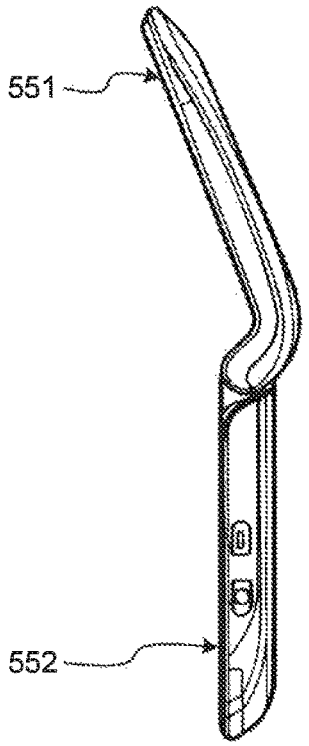
FIG. 15 is a diagram illustrating an example of the electronic apparatus including the display device according to the embodiment of the present disclosure.
Figure 16:
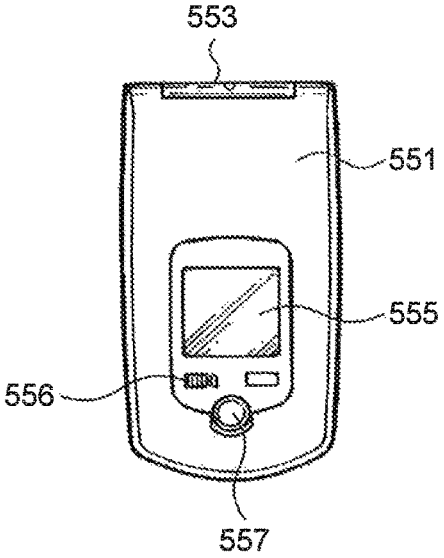
FIG. 16 is a diagram illustrating an example of the electronic apparatus including the display device according to the embodiment of the present disclosure.
Figure 17:
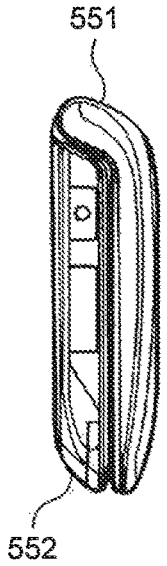
FIG. 17 is a diagram illustrating an example of the electronic apparatus including the display device according to the embodiment of the present disclosure.
Figure 18:
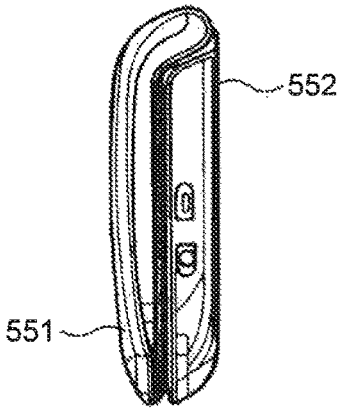
FIG. 18 is a diagram illustrating an example of the electronic apparatus including the display device according to the embodiment of the present disclosure.
Figure 19:
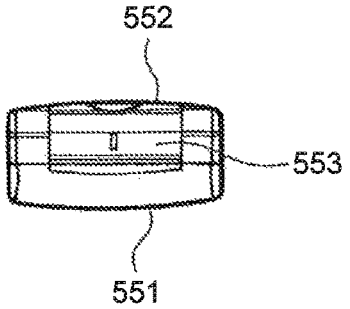
FIG. 19 is a diagram illustrating an example of the electronic apparatus including the display device according to the embodiment of the present disclosure.
Figure 20:
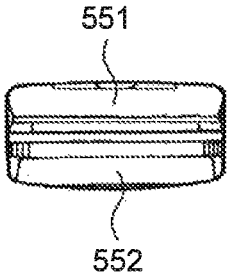
FIG. 20 is a diagram illustrating an example of the electronic apparatus including the display device according to the embodiment of the present disclosure.

The electronic apparatus illustrated in FIG. 13 is a notebook-type personal computer to which the display device 10 is applied. The notebook-type personal computer includes, for example, a main body 541, a keyboard 542 for an input operation of characters and the like, and a display unit 543 for displaying an image. The display device 10 is applied to the display unit 543. Accordingly, the display unit 543 of the notebook-type personal computer has a function of detecting a touch operation, in addition to a function of displaying an image.

Application Example 5

The electronic apparatus illustrated in FIG. 14 to FIG. 20 is a mobile phone to which the display device 10 is applied. The mobile phone is, for example, configured by connecting an upper housing 551 and a lower housing 552 with a connecting part (hinge part) 553, and includes a display unit 554, a sub-display unit 555, a picture light 556, and a camera 557. The display device 10 is mounted on the display unit 554. Accordingly, the display unit 554 of the mobile phone has a function of detecting a touch operation, in addition to a function of displaying an image.

Application Example 6

Figure 21:
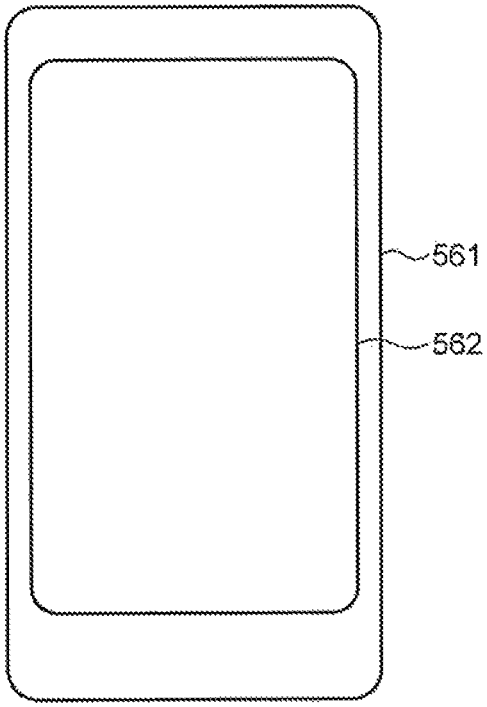
FIG. 21 is a diagram illustrating an example of the electronic apparatus including the display device according to the embodiment of the present disclosure.

The electronic apparatus illustrated in FIG. 21 is a mobile phone or what is called a smartphone, to which the display device 10 or the like is applied. The mobile phone includes, for example, a touch panel 562 arranged on a surface of a substantially rectangular thin-plate housing 561. The touch panel 602 includes the display device 10, for example.

Application Example 7

Figure 22:
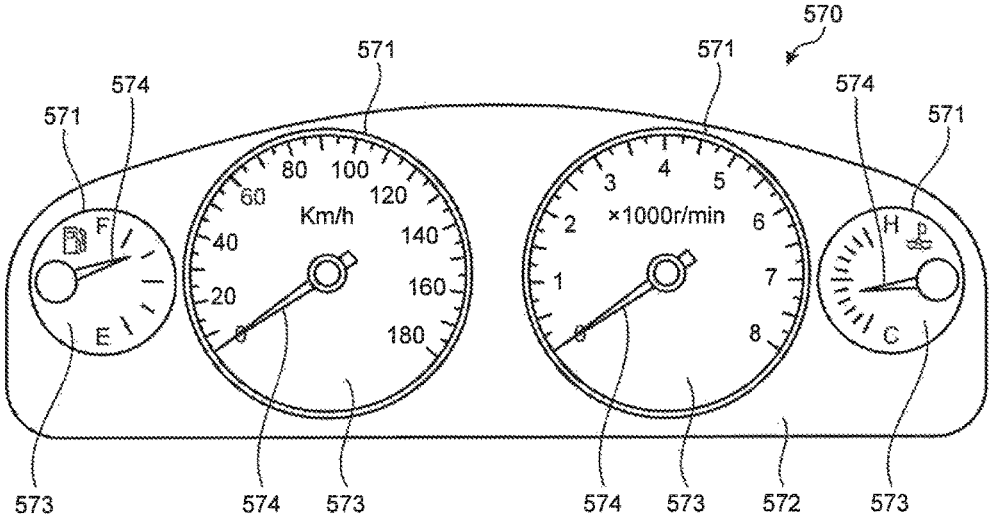
FIG. 22 is a diagram illustrating an example of the electronic apparatus including the display device according to the embodiment of the present disclosure.

The electronic apparatus illustrated in FIG. 22 is a meter unit mounted on a vehicle. A meter unit (electronic apparatus) 570 illustrated in FIG. 22 includes a plurality of liquid crystal display devices 571 such as a fuel gauge, a water-temperature gauge, a speedometer, and a tachometer. The liquid crystal display devices 571 are all covered with one exterior panel 572.

Each of the liquid crystal display devices 571 illustrated in FIG. 22 is configured by combining a liquid crystal panel 573 serving as liquid crystal display means and a movement mechanism serving as analog display means. The movement mechanism includes a motor serving as driving means and an indicator 574 rotated by the motor. As illustrated in FIG. 22, in the liquid crystal display device 571, a scale and a warning can be displayed on a display surface of the liquid crystal panel 573, and the indicator 574 of the movement mechanism can be rotated on the display surface side of the liquid crystal panel 573. The display device 10 according to the embodiment is applied to the liquid crystal display device 571.

In FIG. 22, the liquid crystal display devices 571 are arranged in one exterior panel 572. However, the embodiment is not limited thereto. Alternatively, one liquid crystal display device may be provided in a region surrounded by the exterior panel to display a fuel gauge, a water-temperature gauge, a speedometer, a tachometer, and the like on the liquid crystal display device.

According to the embodiment, the present invention discloses the following display device, method for driving the display device, and electronic apparatus.

(1) A display device including:

an image display unit that includes an image display region;

a plurality of light sources that are arranged corresponding to a plurality of partial regions included in the image display region and irradiate the partial regions with light;

a light amount correction processing unit that detects that the partial regions are non-display regions in which no image is displayed, and corrects a light amount of the light sources based on a predetermined threshold when the partial regions adjacent to each other are continuous non-display regions; and a light source control unit that controls the light amount of the light sources.

(2) The display device according to (1), wherein the light amount correction processing unit increases the light amount of the light source having a lower light amount so as to be approximated to the light amount of the light source having a higher light amount, among the light sources that are arranged in the partial regions adjacent to each other.

(3) The display device according to (1), wherein the light amount correction processing unit detects whether the partial regions are non-display regions in a first direction of the image display region, and then detects whether the partial regions are non-display regions in the reverse direction of the first direction.

(4) A method for driving a display device, the method including:

detecting that a plurality of partial regions included in an image display region are non-display regions; and correcting an amount of light of light sources that are arranged corresponding to the non-display regions when the partial regions adjacent to each other are continuous non-display regions.

(5) The method for driving a display device according to (4), wherein at the correcting, the amount of light of the light source the light amount of which is low is corrected to be increased so as to be approximated to the amount of light of the light source the light amount of which is high, among the light sources that are arranged corresponding to the partial regions adjacent to each other.

(6) The method for driving a display device according to (4), wherein at the detecting, the partial regions are detected to be non-display regions in a first direction of the image display region, and then the partial regions are detected to be non-display regions in the reverse direction of the first direction.

(7) An electronic apparatus including:

a display device including:

an image display unit that includes an image display region;

a plurality of light sources that are arranged corresponding to a plurality of partial regions included in the image display region and irradiate the partial regions with light;

a light amount correction processing unit that detects that the partial regions are non-display regions in which no image is displayed, and corrects a light amount of the light sources based on a predetermined threshold when the partial regions adjacent to each other are continuous non-display regions; and a light source control unit that controls the light amount of the light sources; and a controller that controls the display device.

The present invention provides the display device that can prevent the black floating from occurring even when the high-saturation image is displayed, the method for driving the display device, and the electronic apparatus.

What is claimed is:

1. A display device comprising:

an image display unit that includes an image display region;

a plurality of light sources that are arranged corresponding to a plurality of partial regions included in the image display region and configured to irradiate the partial regions with light;

a light source control unit configured to control a light amount of each of the light sources; and a light amount correction processing unit configured to correct the light amount of the each of light sources by controlling via the light source control unit when detecting that the partial regions continuous and adjacent to each other are non-display regions in which no image is displayed, wherein the light amount correction processing unit is configured to:

detect, proceeding along a first direction of the image display region, two or more continuous partial regions that are the non-display regions, set, when detecting the two or more continuous partial regions, a flag to each of a first subset the plurality of light sources which irradiate the continuous partial regions with light, measure the light amount of each of the first subset of the plurality of light sources which irradiate the continuous partial regions with light and to which the flag is set, perform processes of:

comparing a difference value between a first light amount of a first light source and a second light amount of a second light source that is positioned adjacent to and downstream of the first light source in the first direction with a predetermined threshold, the first and second light sources being among the first subset of the plurality of light sources, determining whether to perform a correction of the respective light amount based on a result of the comparison, and correcting, when it is determined to perform the correction, the second light amount, repeat the comparison, determination, and correction processes, when there are three or more light sources including in the subset of the plurality of light sources, until reaching the final two adjacent light sources in the first direction, detect, proceeding along a second direction reverse to the first direction, two or more continuous partial regions that are the non-display regions, set, when detecting the two or more continuous partial regions, a flag to each of a second subset the plurality of light sources which irradiate the continuous partial regions with light, measure the light amount of each of the second subset of the plurality of light sources which irradiate the continuous partial regions with light and to which the flag is set, perform processes of:

comparing a difference value between a third light amount of a third light source and a fourth light amount of a fourth light source that is positioned adjacent to and downstream of the third light source in the second direction with the predetermined threshold, the third and fourth light sources being among the second subset of the plurality of light sources, determining whether to perform a correction of the respective light amount based on a result of the comparison, and correcting, when it is determined to perform the correction, the fourth light amount, and repeat the comparison, determination, and correction processes, when there are three or more light sources including in the subset of the plurality of light sources, until reaching the final two adjacent light sources in the second direction.

2. The display device according to claim 1, wherein the light amount correction processing unit is configured to increase the light amount of a respective light source having a lower light amount so as to be approximated to the light amount of a respective light source having a higher light amount, among the light sources that are arranged in the partial regions adjacent to each other.

3. The display device according to claim 1, further comprising an external light sensor configured to detect a luminance of each of the partial regions, wherein the light amount correction processing unit is configured to determine whether each of the partial regions is a non-display region based on the luminance of each of the partial regions detected by the external light sensor.

4. A method for driving a display device including an image display unit that includes an image display region, a plurality of light sources that are arranged corresponding to a plurality of partial regions included in the image display region and configured to irradiate the partial regions with light, a light source control unit configured to control a light amount of each of the light sources, and a light amount correction processing unit configured correct the light amount of each of the light sources, the method comprising:

correcting the light amount of each of the light sources by controlling via the light source control unit when detecting that the partial regions continuous and adjacent to each other are non-display regions in which no image is displayed, wherein the correcting includes:

detecting, proceeding along a first direction of the image display region, two or more continuous partial regions that are the non-display regions, setting, when detecting the two or more continuous partial regions, a flag to each of a first subset the plurality of light sources which irradiate the continuous partial regions with light, measuring the light amount of each of the first subset of the plurality of light sources which irradiate the continuous partial regions with light and to which the flag is set, performing processes of:

comparing a difference value between a first light amount of a first light source and a second light amount of a second light source that is positioned adjacent to and downstream of the first light source in the first direction with a predetermined threshold, the first and second light sources being among the first subset of the plurality of light sources, determining whether to perform a correction of the respective light amount based on a result of the comparison, and correcting, when it is determined to perform the correction, the second light amount, repeating the comparison, determination, and correction processes, when there are three or more light sources including in the subset of the plurality of light sources, until reaching the final two adjacent light sources in the first direction, detecting, proceeding along a second direction reverse to the first direction, two or more continuous partial regions that are the non-display regions, setting, when detecting the two or more continuous partial regions, a flag to each of a second subset the plurality of light sources which irradiate the continuous partial regions with light, measuring the light amount of each of the second subset of the plurality of light sources which irradiate the continuous partial regions with light and to which the flag is set, performing processes of:

comparing a difference value between a third light amount of a third light source and a fourth light amount of a fourth light source that is positioned adjacent to and downstream of the third light source in the second direction with the predetermined threshold, the third and fourth light sources being among the second subset of the plurality of light sources, determining whether to perform a correction of the respective light amount based on a result of the comparison, and correcting, when it is determined to perform the correction, the fourth light amount, and repeat the comparison, determination, and correction processes, when there are three or more light sources including in the subset of the plurality of light sources, until reaching the final two adjacent light sources in the second direction.

5. The method for driving a display device according to claim 4, wherein the correcting includes increasing the light amount of a respective light source having a lower light amount so as to be approximated to the light amount of a respective light source having a higher light amount, among the light sources that are arranged corresponding to the partial regions adjacent to each other.

6. The method for driving a display device according to claim 4, wherein the detecting includes:

detecting a luminance of each of the partial regions in the image display region by an external light sensor, and detecting whether each of the partial regions is a non-display region based on the luminance of each of the partial regions detected by the external light sensor.

* * * * *